US005921114A

United States Patent [19]

Jung

[11] Patent Number: 5,921,114

[45] Date of Patent: Jul. 13, 1999

[54] PULSATOR FOR WASHING MACHINE

[75] Inventor: Byung Don Jung, Suwon, Rep. of Korea

[73] Assignee: Samsung Electronics Co., Ltd., Suwon, Rep. of Korea

[21] Appl. No.: 09/061,895

[22] Filed: Apr. 17, 1998

[30] Foreign Application Priority Data

| | | | |
|---|---|---|---|
| Apr. 17, 1997 | [KR] | Rep. of Korea | 97-14237 |
| Apr. 17, 1997 | [KR] | Rep. of Korea | 97-14241 |
| Apr. 17, 1997 | [KR] | Rep. of Korea | 97-14243 |
| Apr. 28, 1997 | [KR] | Rep. of Korea | 97-15988 |
| Apr. 28, 1997 | [KR] | Rep. of Korea | 97-15989 |

[51] Int. Cl.[6] ..... D06F 17/10

[52] U.S. Cl. ..... 68/133; 68/134

[58] Field of Search ..... 68/133, 134

[56] References Cited

U.S. PATENT DOCUMENTS

| | | | |
|---|---|---|---|
| 5,680,779 | 10/1997 | Na | 68/134 X |
| 5,680,780 | 10/1997 | Kim et al. | 68/134 |
| 5,727,404 | 3/1998 | Cho | 68/133 |
| 5,765,405 | 6/1998 | Jung et al. | 68/134 X |
| 5,765,406 | 6/1998 | Youn | 68/134 |
| 5,839,300 | 11/1998 | Yoon et al. | 68/134 |

*Primary Examiner*—Philip R. Coe
*Attorney, Agent, or Firm*—Burns, Doane, Swecker & Mathis, L.L.P.

[57] ABSTRACT

A pulsator for a washing machine installed in a washing tub is provided. The present pulsator for a washing machine comprises: a main body installed rotatably on a bottom of the washing tub with a vertical axis, and having a fan chamber and a upper surface formed with at least a spout outlet which is open upwardly and is in a flow communication with the fan chamber; a spout fan having a fan shaft with an axis parallel with the vertical axis of the main body and a plurality of fan blades extending radially from the fan shaft, the spout fan being received in the fan chamber for rotation relative to the main body to eject washing water upwards through the spout outlet; a bearing means for rotatably supporting the fan shaft in a radial direction as well as an axial direction; and means for rotating the spout fan. Accordingly the spout fan can be supported by a simple supporting structure. Further, an effective vertical uprising stream is generated in the washing tub, so that twisting and entangle of laundry is prevented.

9 Claims, 9 Drawing Sheets

PULSATOR FOR WASHING MACHINE

BACKGROUND OF THE INVENTION

1. Field of the Invention

The present invention relates to a pulsator for a washing machine, and more particularly, to a pulsator for a washing machine capable of generating a vertical uprising stream in a washing tub, and having a simple supporting structure for a spout fan generating the vertical uprising stream.

2. Description of the Related Art

A pulsator for washing machine is provided in a washing tub to generate washing stream of water for washing laundry.

FIG. 11 is a schematic vertical sectional view of a washing machine in which a conventional pulsator is installed. As shown in FIG. 11., a washing machine 151 includes an external casing 153 for forming external appearance, and a washing system 161 for washing laundry which is suspension-supported by suspension unit in the external casing 153. The washing system 161 comprises a washing tub 163, a dewatering tub 167 rotatably installed in the washing tub 163, a pulsator 169 rotatably installed in the dewatering tub 167 and a driving unit 171 for driving the rotation of the dewatering tub 167 and/or the pulsator 169.

The pulsator 169 for the washing machine 151 which is shaped in the form of a disk has a shaft combiner 168 connected with a driving axis of the driving unit 171 and a plurality of washing blades radially extended from the shaft combiner 168. The pulsator 169 rotates in the forward and reward directions by the driving force of the driving unit 171, so that washing stream of water is generated by the washing blades in the washing tub 167. The washing stream of water forms a circulating loop, that is, the washing stream of water is spread radially by the centrifugal force of the pulsator 169 in the lower portion of the washing tub 163, and then rises up along the inner wall surface of the washing tub 163 to then descend at the center portion of the washing tub 163. Under the circumstances, the laundry in the washing tub 163 move along the circulation of the stream, in such a manner that they contact not only each other but also with the pulsator 169 and the dewatering tub 167, so that washing can be carried out, However, the conventional pulsator generates a circulation stream of water in the washing tub 163 as shown the arrows in FIG. 11. Therefore, the laundry in the washing tub 163 move along the circulating stream of water of a consistent direction being formed in the washing tub 113, in such a circulation manner that the laundry get twisted and entangled mutually. Then, volume and weight of the laundry are gradually increased, to thereby reduce a rotational force of the pulsator 169 so that a washing capability is lowered. Moreover., the laundry which move in a entangle may he easily damaged during washing and dewatering. Furthermore, after dewatering, a user is inconvenienced by arrangement or alignment of the laundry.

SUMMARY OF THE INVENTION

To solve the above problems, it is an object of the present invention to provide a pulsator for a washing machine which can generate a vertical uprising stream of water in a washing tub to prevent twist and entangle of laundry, and having a simple suspending structure for a spout fan which is generating the vertical uprising stream.

To accomplish the above object of the present invention, there is provided a pulsator for a washing machine installed in a washing tub, comprising: a main body installed rotatably on a bottom of the washing tub with a vertical axis, and having a fan chamber and an upper surface formed with at least a spout outlet which is open upwardly and is in a flow communication with the fan chamber; a spout fan having a fan shaft with an axis parallel with the vertical axis of the main body and a plurality of fan blades extending radially from the fan shaft, the spout fan being received in the fan chamber for rotation relative to the main body to eject washing water upwards through the spout outlet; a bearing means for rotatably supporting the fan shaft in a radial direction as well as an axial direction; and means for rotating the spout fan.

Here, the bearing means can be simply constructed by including a pivot supporting member mounted on the main body and having a pivot recess for accommodating a lower end of the fan shaft to support slidably the lower end of the fan shaft axially and radially. If the lower end of the fan shaft and the pivot recess has a partially spherical contact surface corresponding to each other the frictional force of the contact surface is decreased resulting in rising the rotational force of the spout fan.

The bearing means can be structured by further including an upper support projection projecting downwardly from a ceiling surface of the fan chamber in the axial direction of the fan shaft, and an engaging recess formed at the upper end of the fan shaft to receive the upper support projection in the axial direction of the fan shaft.

Meanwhile, the rotating means can be simply constructed by including a pinion mounted integrally on the fan shaft, and a driving gear fixed on the bottom of the washing tub to cooperate with the pinion. Here, it is preferable that the pinion has a lower contact surface toward the pivot supporting member, and the pivot supporting member has an axial bearing surface coming into an axial contact with the lower contact surface of the pinion.

Further, the fan shaft has a journal provided above the pinion, and the bearing means can be constructed by further including a radial supporting member having a radial bearing part surrounding annularly the journal. The radial supporting member can be simply constructed if a radial sector-shaped supporting part connecting the radial bearing part with a side wall of the fan chamber is provided. Here, it is preferable that the pinion has an upper contact surface toward the radial bearing part, and the radial bearing part has an axial bearing surface coming into an axial contact with the upper contact surface of the pinion.

BRIEF DESCRIPTION OF THE DRAWINGS

The above object and advantages of the present invention will be apparent by describing the structure and operation thereof in detail with reference to the attached drawings in which.

DETAILED DESCRIPTION OF THE INVENTION

Figure 1:
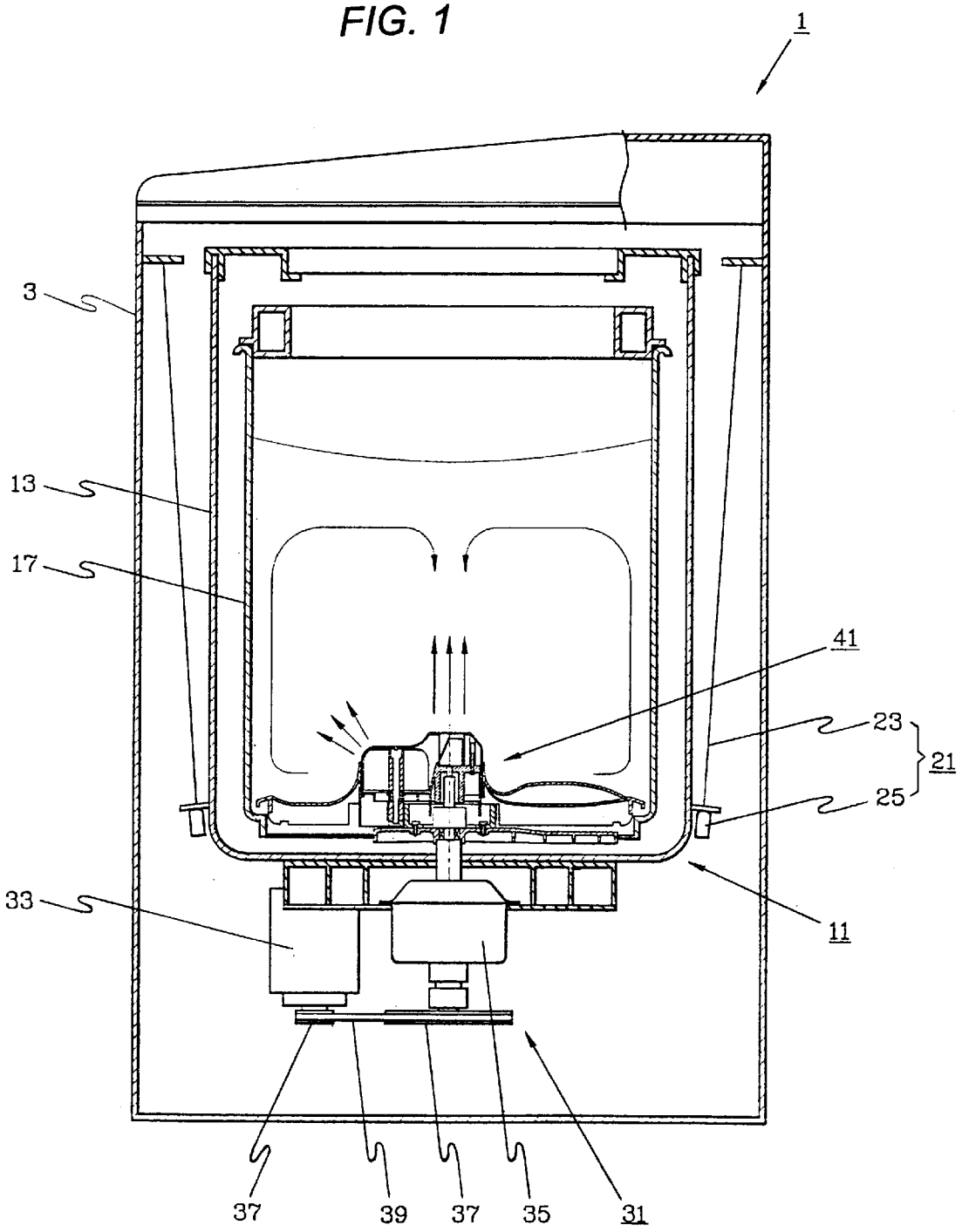
FIG. 1 is a schematic vertical sectional view of a washing machine in which a pulsator for a washing machine according to the present invention is installed.
Figure 2:
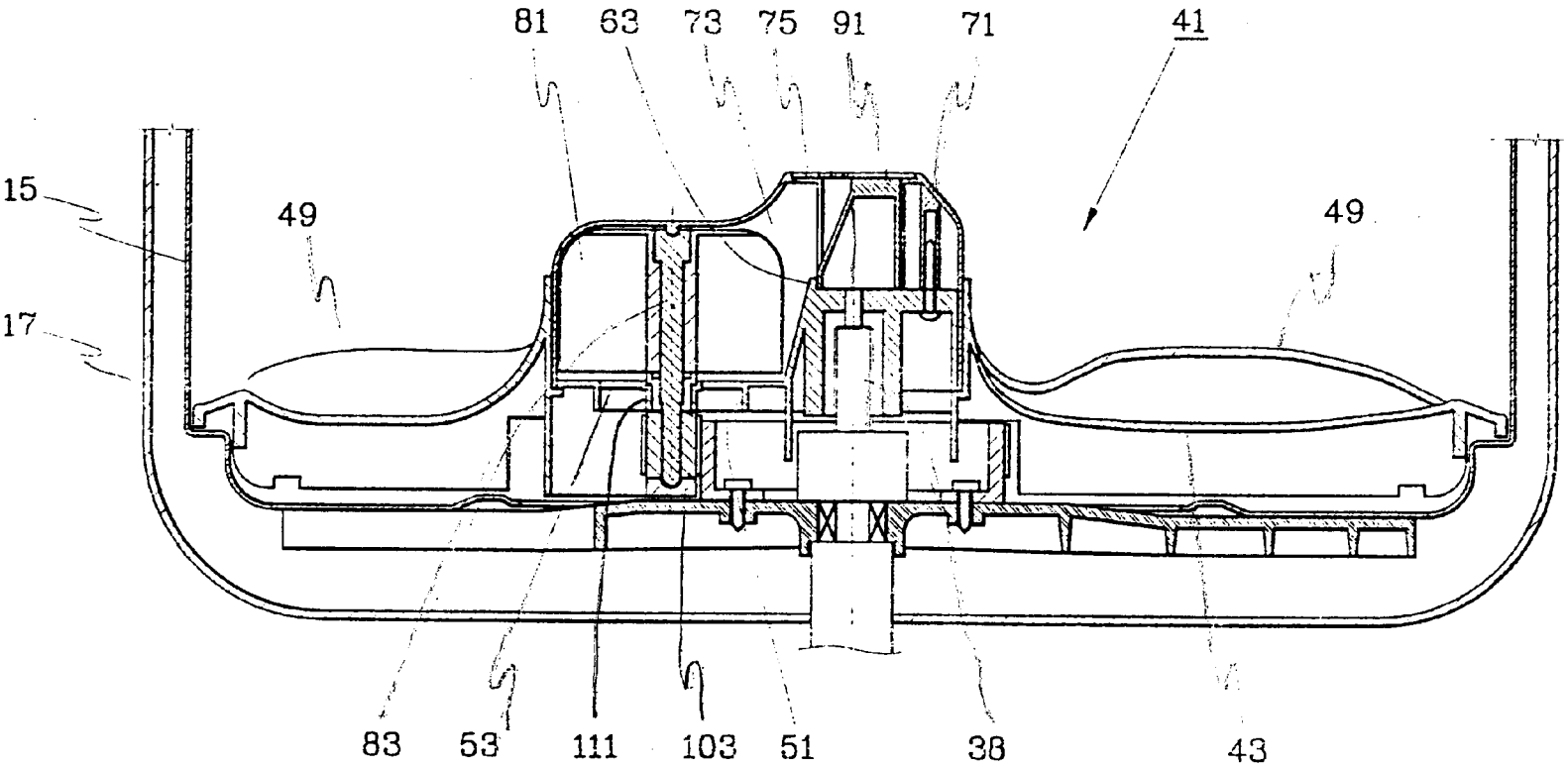
FIG. 2 is a partially enlarged view of FIG. 1.
Figure 3:
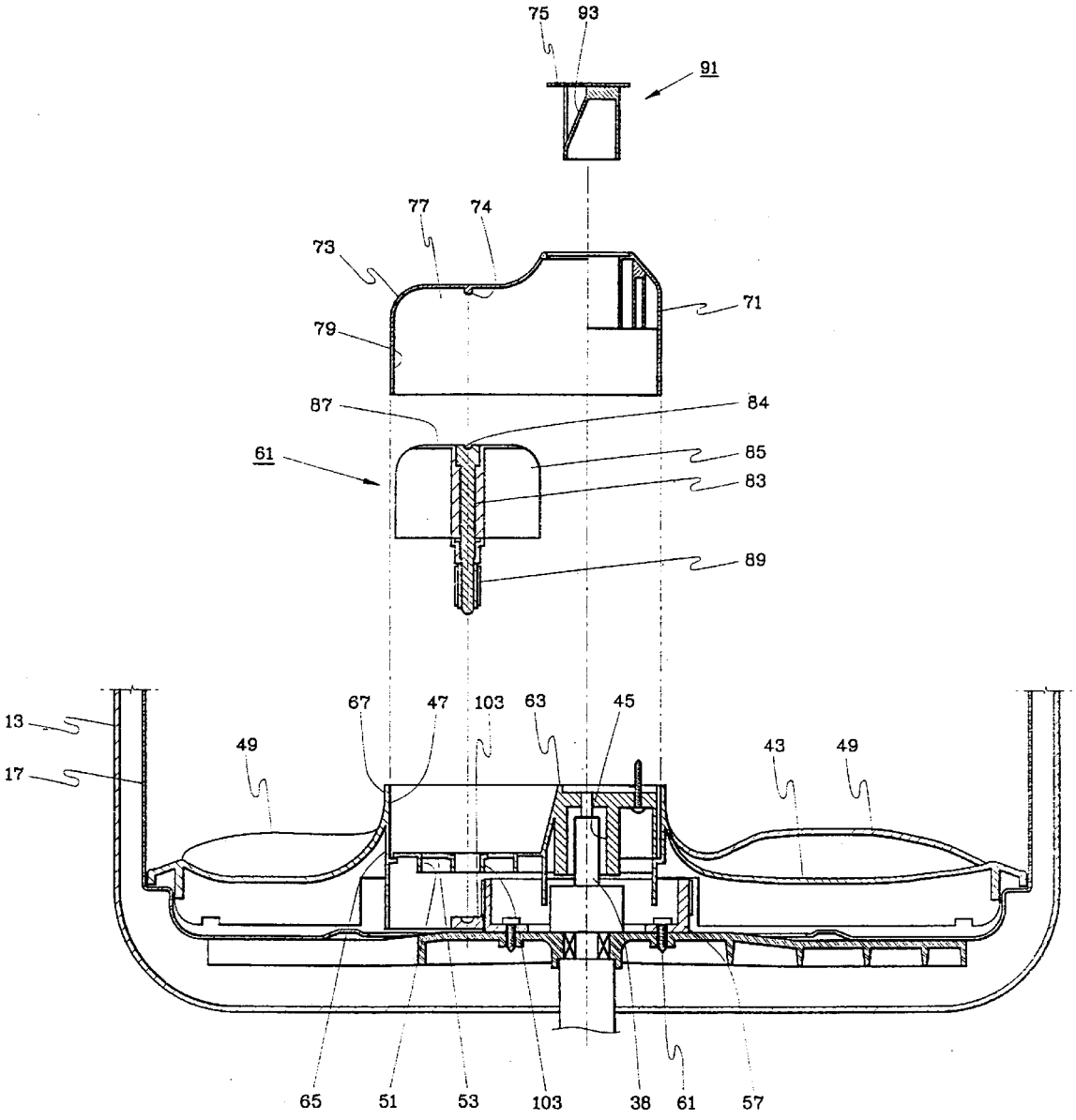
FIG. 3 is an exploded view of FIG. 2.

FIG. 1 is a schematic vertical sectional view of a washing machine in which a pulsator for a washing machine according to the present invention is installed, FIG. 2 is a partially enlarged view of FIG. 1 and FIG. 3 is an exploded view of FIG. 2. As shown in FIGS. 1 through 3, a washing machine 1 according to the present invention includes an external casing 3 constituting external appearance, and a washing system 11 for washing laundry which is suspension-support in the external casing 3. The washing system 11 includes a washing tub 13 supported a suspension unit 21 and a driving unit 31 installed underneath the lower side of the washing tub 13. The washing tub 13 has a dewatering tub 17 rotatably installed therein. A pulsator 41 is rotatably installed in the dewatering tub 17.

The suspension unit 21 includes suspension strings 23 and dampers 25 mounted on the external wall of the washing tub 13. The upper end of the suspension strings 23 is connected to the external casing 3 and the lower end thereof is connected to the damper 25.

The driving unit 31 includes a driving motor 33 and a shaft assembly 35 for selectively transmitting the driving force of the driving motor 33 to the dewatering tub 17 and the pulsator 41. The shaft assembly 35 is controlled by a controller (not shown), to thereby rotate the pulsator 41 during washing, and rotate the pulsator 41 and the dewatering tub 17 integrally during dehydration. The shaft assembly 35 and the driving motor 33 are operatively connected with each other via a pulley 37 and a belt 39.

Figure 4:
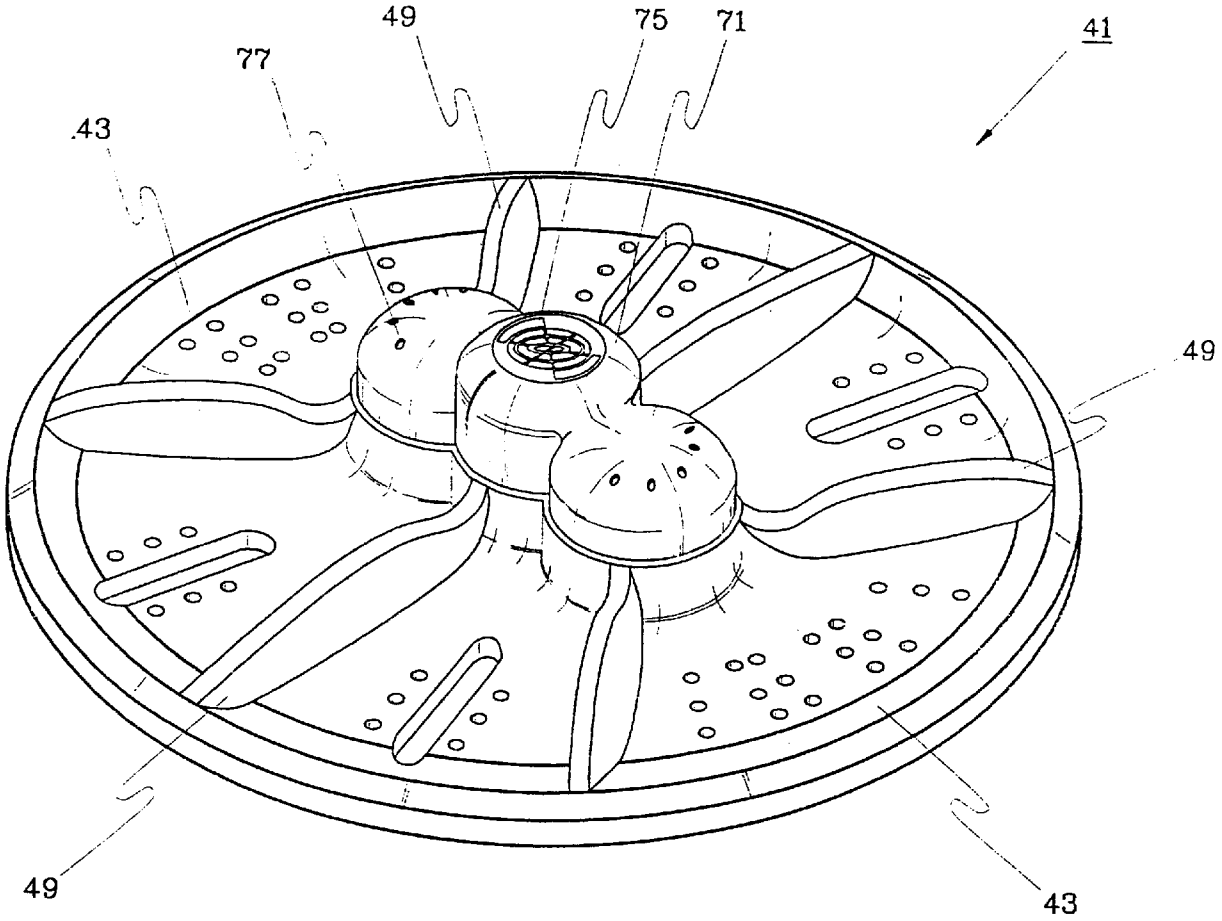
FIG. 4 is a perspective view of a pulsator for a washing machine according to the present invention.
Figure 5:
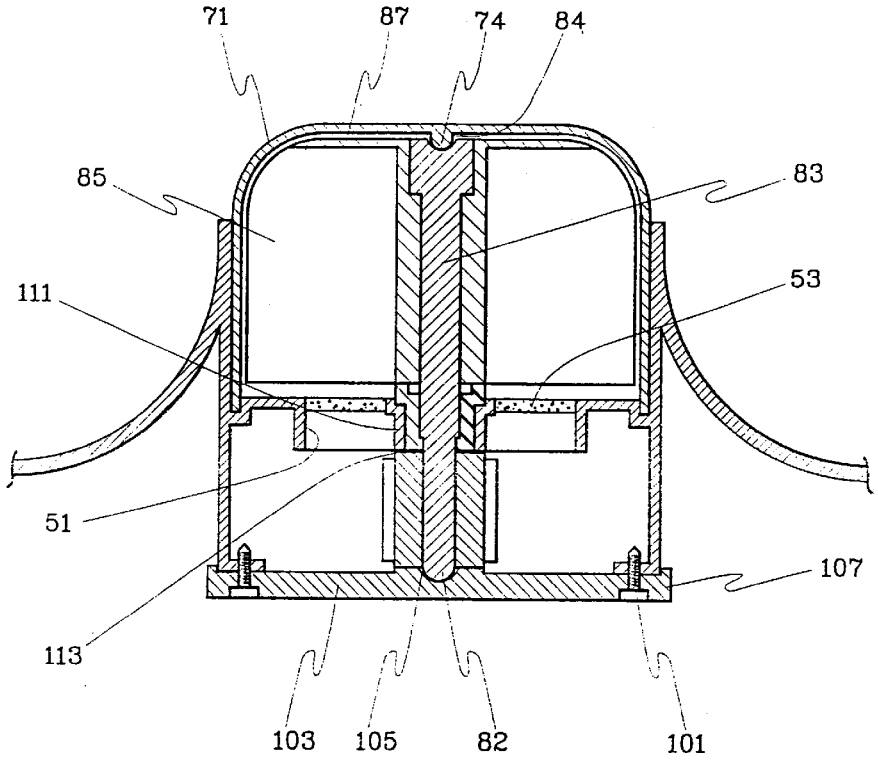
FIG. 5 is a partially enlarged sectional view of FIG. 4.
Figure 6:
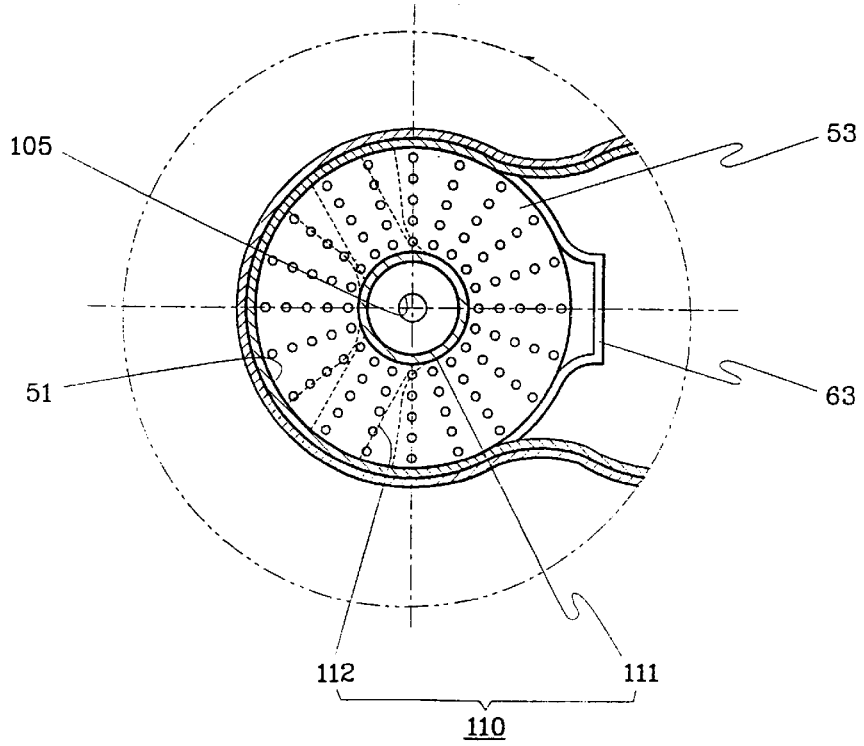
FIG. 6 is a transverse sectional view of FIG. 4.

Meanwhile, FIG. 4 is a perspective view of the pulsator of FIG. 2. FIG. 5 is a plan view of the main body of FIG. 3. The pulsator 41 includes a main body 43 shaped in the form of a substantial disc, spout fans 81 installed in the main body 43 to generate a vertical uprising stream and a driving part 8(for rotating the spout fans 81. A cover member 71 having a spout outlet 75 which is open upward on an upper surface thereof is connected on the central upper surface of the main body 43 to form a predetermined fan chamber 73. The fan chamber 73 is provided with a bearing part 741. 84, 103 and 110 for supporting the rotation of the respective spout fan 81 therein.

The main body 43 includes a shaft combiner 45 connected with a driving axis 38 of the driving unit 31, a washing water stream outlet 47 which is open upward in the center region and a plurality of washing blades radially extended from the washing water stream outlet 47. The washing blades 49 play a role of generating washing streams of water during the forward and reward rotation of the pulsator 41. A pair of washing water stream inlets 51 which are opposed to each other across the rotational axial line of the pulsator 41 and open downward are also provide(d in the main body 43. AR porous plate filter 5: is installed in each washing water stream inlet 51. The filters 53 each play a role of preventing inflow of the leftover included in the washing water.

The cover member 71 is combined with the main body 43 to cover the upper portion of the washing water stream outlet 47, and constitutes a pair of fan chambers 73 which are opposed to each other with respect to the rotational axial line between the cover member 71 and the main body 43. A spout outlet 75 is formed open upward along the rotational axial line of the main body 43 on the central region of the cover member 71. And, a number of the spout outlets 75 are shaped in the form of an arc along the circumferential direction in at least partial section of angular, centered on the rotational axial line of the main body 43. The spout outlets 75 are formed mutually concentrically with respect to the rotational axial line. A plurality of scattering water stream holes 77 are formed on the cover member 71, that is on t he upper portion of the fan chamber 73 which are mutually opposing centered on the spout outlets The mutual combining of the pulsator 43 with the cover member 71 is accomplished by an engagement edge 79 of the cover member 71 and an engagement groove 65 which is formed at the main body 43 to receive the engagement edge 79 of the cover member 71. A cover accommodation part 67 protruded and extended upward from the main body 43 is provided along the lengthy direction on the opening edge of the washing water stream outlet 47. The cover accommodation part 67 has an nonuniform radius with respect to the rotational axial line of the main body 43 and is provided so that the inner wall thereof closely accommodates the outer wall of the cover member 71. A engagement groove 65 is depressed in parallel with the cover accommodation part 67 on the plate surface of the main body 43 adjacent to the cover accommodation part 67. The engagement edge 79 of the cover member 71 accommodated in the cover accommodation part 67 is forcedly fitted with the groove 65.

Figure 7:
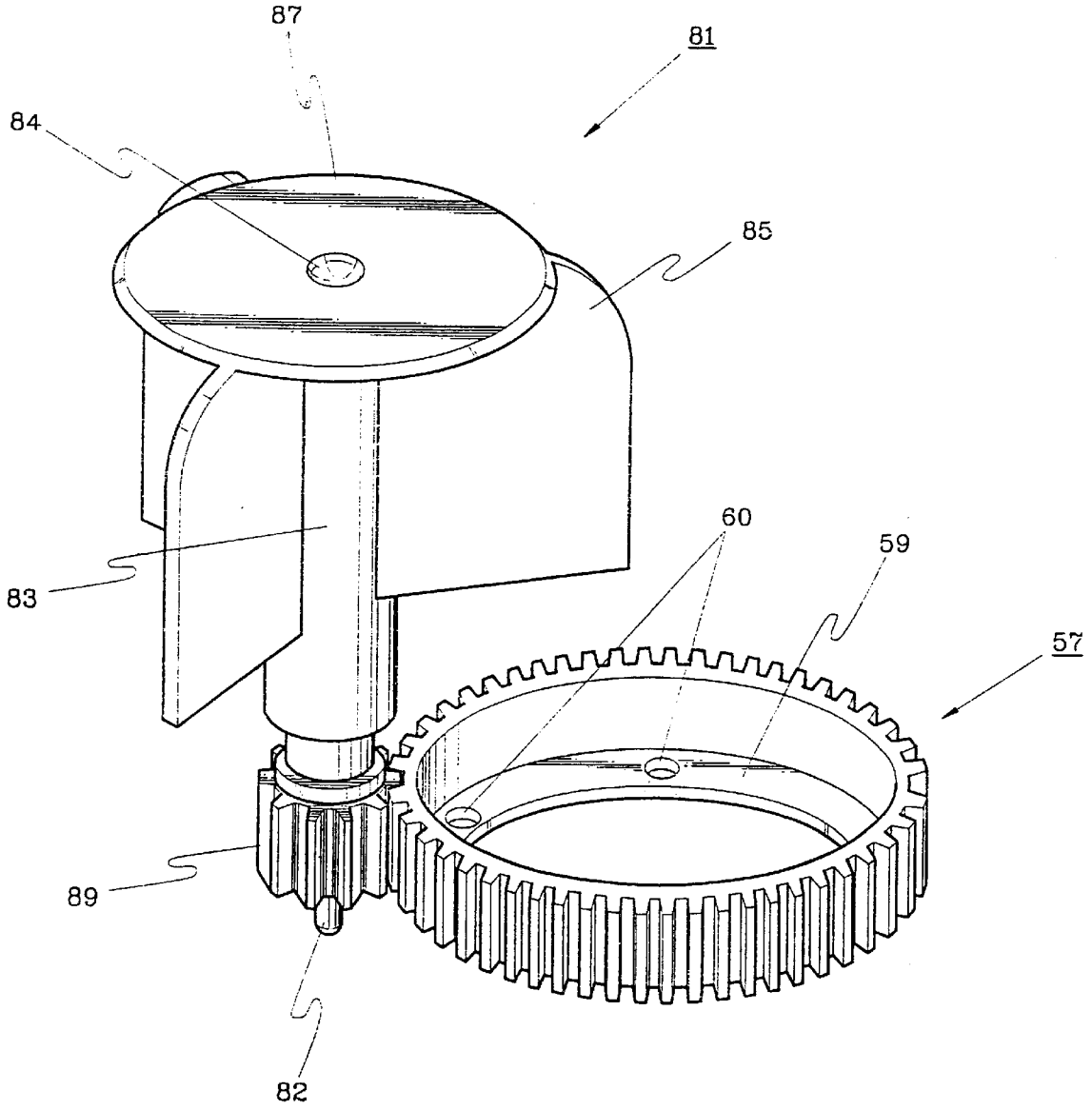
FIG. 7 is a perspective view of a spout fan and a driving gear.
Figure 8:
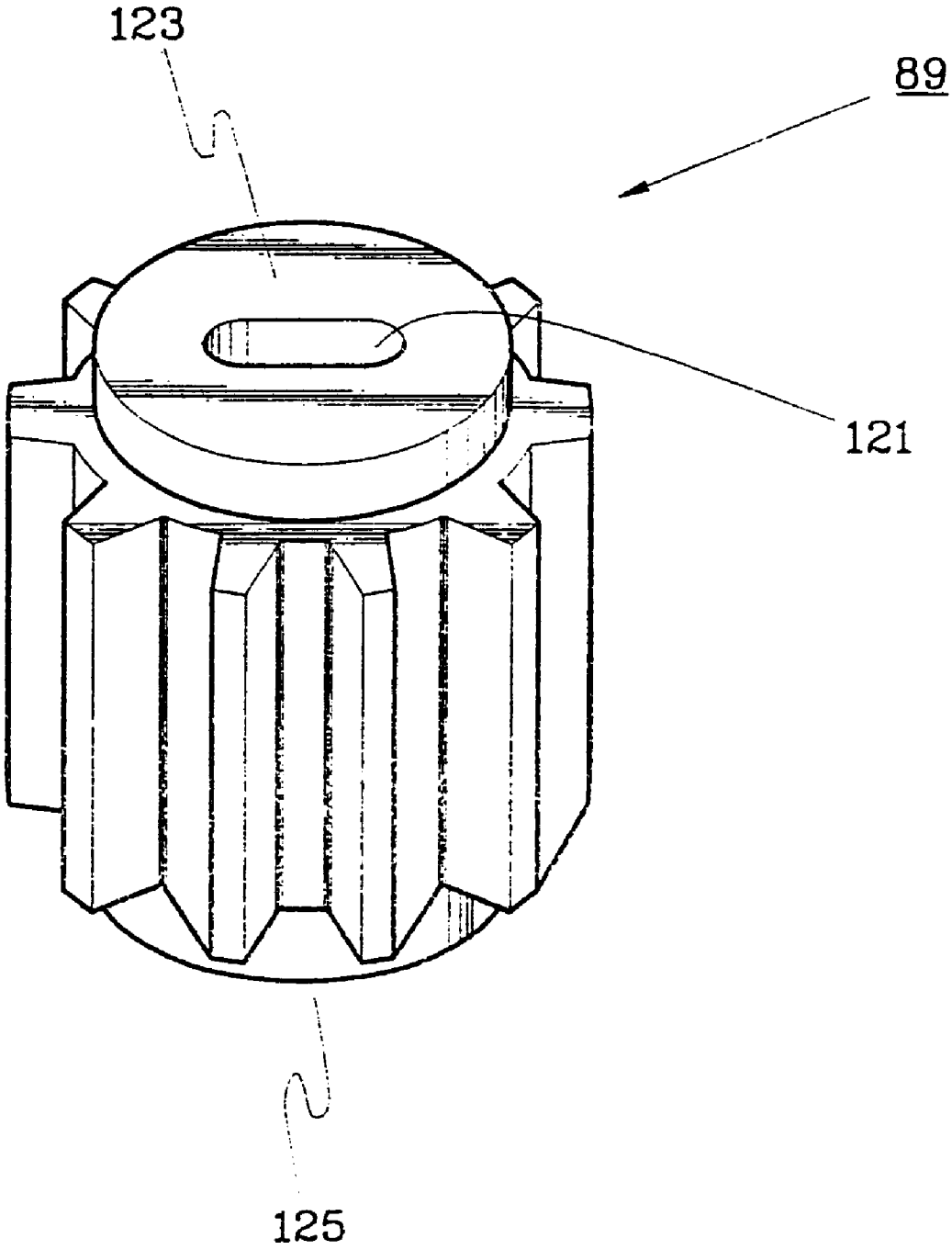
FIG. 8 is an perspective view of a pinion.
Figure 9:
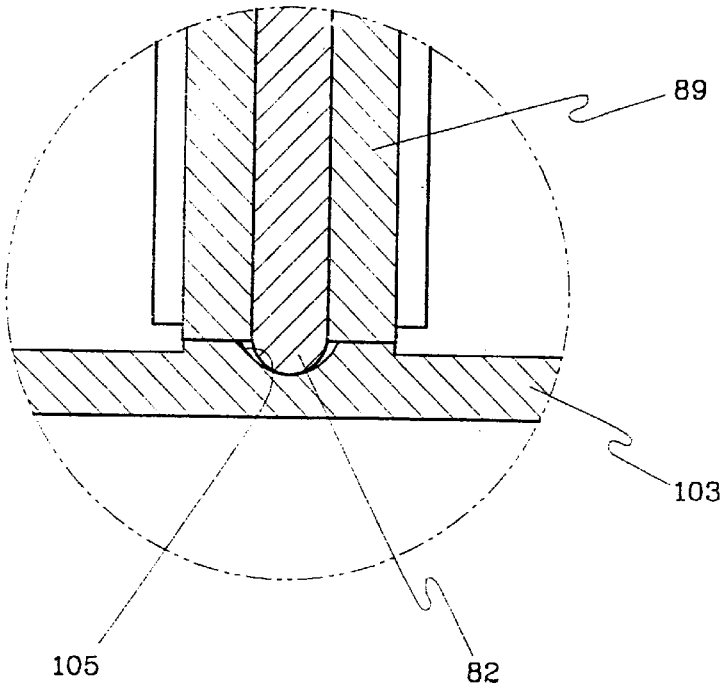
FIG. 9 is a partially enlarged view of FIG. 4.
Figure 10:
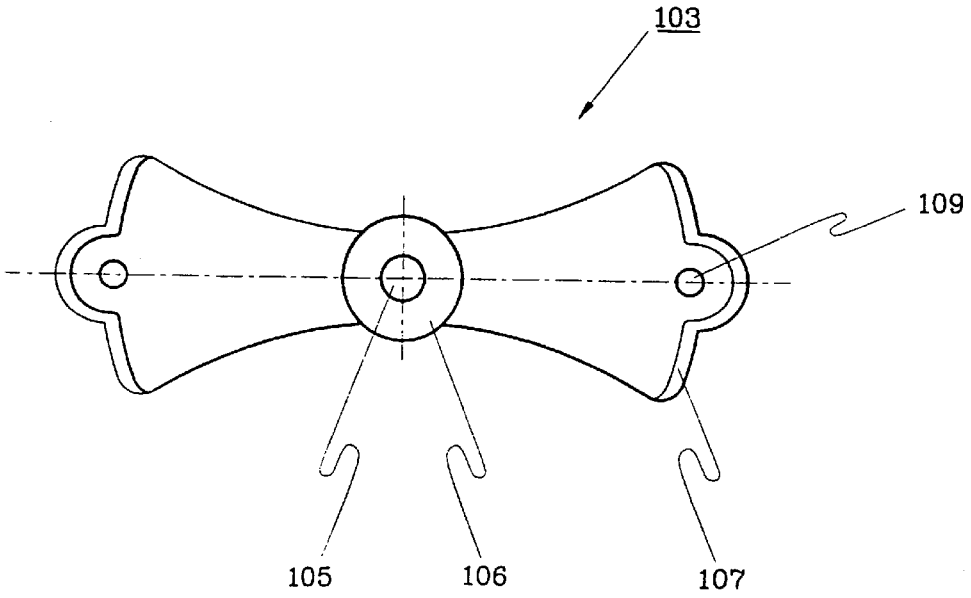
FIG. 10 is a plan view of a pivot supporting member.
Figure 11:
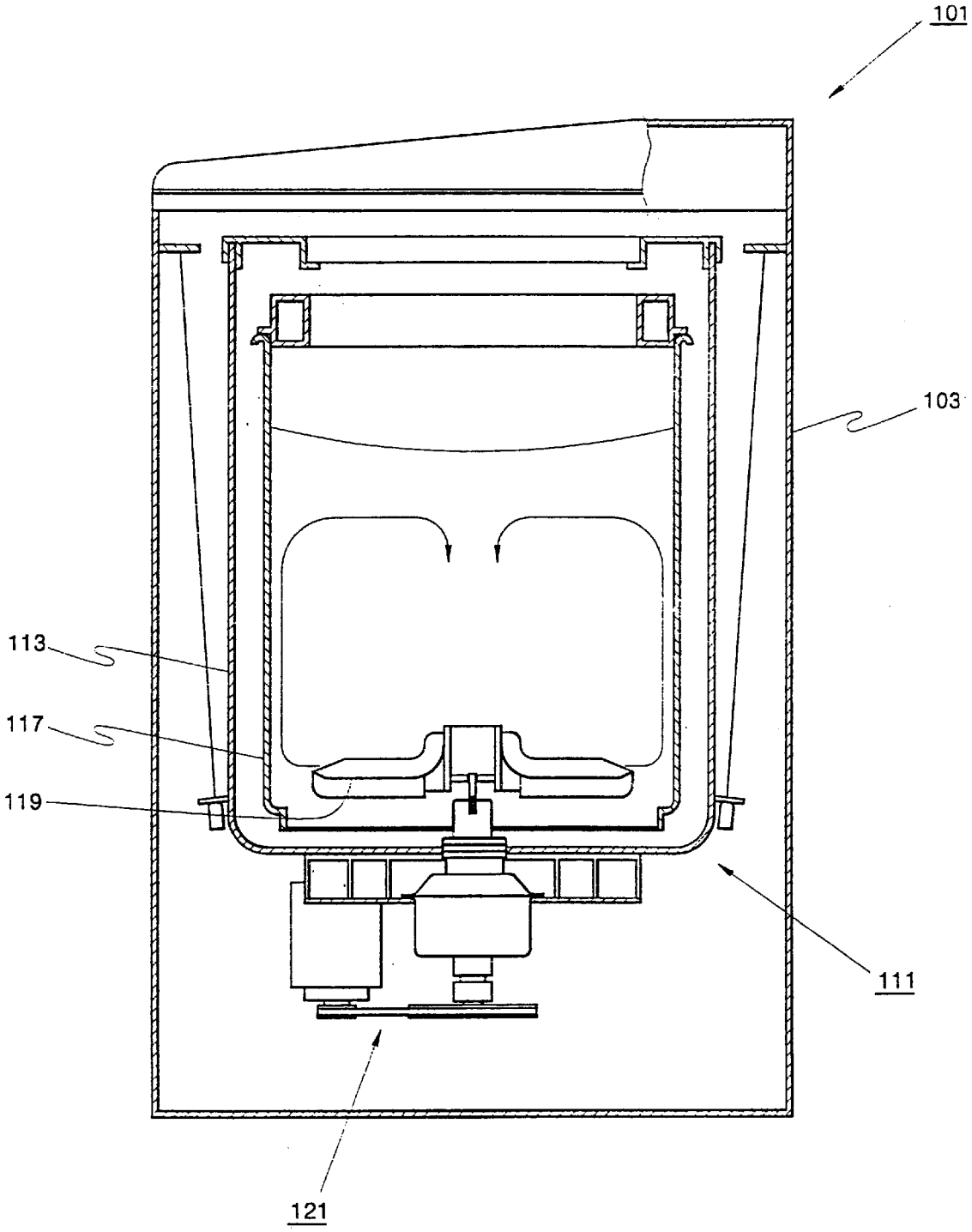
FIG. 11 (PRIOR ART)
FIG. 11 is a schematic vertical sectional view of a washing machine in which a conventional pulsator is installed.

Meanwhile, a spout fan 81 is rotatably installed in the fan chambers 73 respectively, and a duct member 91 is interposed between the spout fans 81 to form a water stream guiding path. FIG. 7 is a perspective view of a spout fan and a driving gear and FIG. 8 is an perspective view of a pinion. As shown FIGS. 7 and 8, the spout fan 81 is a radial fan including a fan shaft 83 parallel with a rotational axial line of the main body 43 and three fan blades 85 extended radially along the axial line of the fan shaft 83. A lower end 82 of the fan shaft 83, as shown FIG. 9, is formed with i a partially sphere-shaped pivot end, and an upper end is formed with an engaging recess 8,1 depressed downward. The pivot end 82 is supported by a pivot supporting member 103 which is horizontally provided on an opening surface of the cover member 71. An upper support projection 74 projecting downward from a ceiling surface of the fan chamber 73 is accommodated in the engaging recess 84. Accordingly, the spout fan 81 can be rotatably supported in the fan chamber 73. An upper end of the fan blades 85 is provided with a transverse support plate 87 of a circular plate shape to be connected. The transverse plate 87 plays a role of scattering the washing water flowing into the washing water stream inlet 51 circumferentially outward during the rotation of the fan blades 85, Meanwhile the pivot supporting member 103, as shown FIG. 10, has a pivot recess 105 on a central region, and is shaped in the form of a bar that width is gradually widened along both lengthy directions, centered on the pivot recess 105. The pivot recess 105 is depressed in the form of a partial sphere having a relatively large radius. Accordingly, the pivot recess 105 can accommodate the lower end 82 of the fan shaft 83 to support the load of the fan shaft 83 in an axial as well as a radial direction. Under the circumstances, the contact surfaces of the pivot recess 105 and the lower end 82 of the fan shaft 84 is reduced, so that the mutual frictional resistance may be reduced during rotating. Further, if the upper support projection 74 and the engaging recess 84 is shaped in the form of a partial sphere, the mutual frictional resistance may be also reduced.

Both ends of the pivot supporting member 103 are respectively provided with a rib 107 projecting upward, to thereby be formally fitted on the side of the washing water stream inlet 51. Both ends are also formed with a screw hole 109 respectively, so that the pivot supporting member 103 is combined by screws 101 which are concluded by passing through the screw hole 109.

The radial supporting member 110 is provided in the fan chamber 73, in which the radial supporting member 110 is disposed above the pivot supporting member 103 with a predetermined distance apart. The radial supporting member 110 has a radial bearing part 111 surrounding annularly the journal of the fan shaft 83 and a sector-shaped supporting part 112 connecting the radial bearing part 111 with a side wall of the fan chamber 73. The radial bearing part 111 supports the journal of the fan shaft 83 slidably to rotate stably without any wobble in the radial direction.

Meanwhile, the spout fan 81 rotates by a pinion 89 installed in the free end of the fan shaft 83 and a driving gear 57 fixed on the bottom portion of the washing tub 13. The pinion 89, as shown FIG. 8, is separately manufactured from the fan shaft 83. The pinion 89 has an axis hole 121 in the central region, and the upper and lower surfaces 123 and 125 thereof have been treated by a surface treatment to serve as a radial bearing part. The pinion 89 is interposed between the pivot supporting member 103 and radial supporting member 110, in such a manner that the fan shaft 83 of the fan chamber 73 is connected in the axis hole 121 along an axial direction. Under the circumstances, the lower contact surface 125 of the pinion 89 contacts frictionally With the radial bearing surface 10G of the pivot supporting member 103 corresponding to thereof and the upper contact surface 123 contacts frictionally with the radial bearing surface 113 of the radial supporting member 110.

The driving gear 57 has a cylindrical shape. A plurality of fixing holes 60 are formed on a flange portion 59 formed along the lower edge of the driving gear 57. The driving gear 57 is fixed by fixing units 61 combined with the fixing holes 60 in the bottom portion of the washing tub 19. A plurality of threads engaged with the teeth of the pinion 89 are formed on the circumferential surface of the driving gear 57. Accordingly, if the main body 43 rotates, the spout fan 81 accommodated in the chamber 73 rotates together. Here since the spout fan 81 is mutually engaged with the driving gear 57 which is relatively stationary state with respect to the main body 43, the spout fan 81 rotates in the counter-direction with respect to the rotation of the pulsator 41.

Meanwhile, the duct member 91 is disposed between the both spout fans 81 in the washing water stream outlet 47 of the main body 43, and has a slope guiding surface 93 which is bent to face the spout fans 81. A pair of stream guiding protrusions 63 are disposed in the central region of the washing water stream outlet 47 to forcedly fit with the duct member 91. The stream guiding protrusion 63 protrudes upward from the main body 43 to contact the lower edge of the duct member 91. The stream guiding protrusion 63 is disposed in the upstream as compared with the edge of the duct member 91 in the water stream guiding path.

In the pulsator 41 for a washing machine 1 according to the preferred embodiment of the present invention by the above structure, at the state interposing the pinion 89 between the pivot and radial supporting member 103 and 110, the spout fan 81 can be slidably supported on the pivot recess 105 of the pivot supporting member 103 easily, that is, by passing the fan shaft 83 thereof through the radial bearing part 111 and the axis hole 121 of the pinion 89. At this time, since the pinion 89 is integrally rotatably connected with the fan shaft 83 of the spout fan 81, and supported by the pivot and the radial supporting member 103 and 110, the use of supplementary member such as a key for connecting them can be eliminated. Therefore, the manufacturing cost can be reduced, and the assembly and disassembly of the spout fan 81 can be very convenient. Thereafter, if the cover member 71 is simply combined on the upper surface of the main body 43, the upper support projection 74 is accommodated in the engaging recess 84 formed the upper end of the fan shaft 83 of the spout fan 81.

Under the circumferences, the load of the spout fan 81 in a radial direction is supported by the pivot supporting member 103 and the journal the spout fan 81 is slidably supported by the radial supporting member 110, so that the spout fan 81 can rotate easily. Then, since the lower end 82 of the fan shaft 83 and the pivot recess 105 of the pivot supporting member 103, and the upper support projection 74 and the engaging recess 84 are shaped in the form of the partial sphere, the friction according to the rotation of the spout fan 81 can be minimized. Further, the lower and upper contact surface 123 and 125 of the pinion 89 contacts frictionally with the radial bearing surface 106 and 113 of the pivot supporting member 103 corresponding to thereof, respectively. Thus, the load of the spout fan 81 being concentrated on the fan shaft 83 is dispersed radially. Therefore, the rotational force of the spout fan 81 is increased, to thereby generate a effectual vertical uprising stream in a washing tub.

Meanwhile, in the washing machine 1 having the pulsator 41 according to the preferred embodiment of the present invention by the above structure, if a washing operation starts and thus the driving motor 33 is driven, the spout fans 81 installed in the fan chambers 73 revolves around the rotational axial Iine of the pulsator 41, and simultaneously rotates due to mutual action with the driving gear 57 fixed on the bottom portion of the washing tub 13. At this time, the washing water in the fan chambers 73 is scattered toward the centrifugal direction due to the rotational force of the spout fan 81 to flow along the water stream guiding path. At the same time, the washing water in the lower portion of the pulsator 41 flows into in the fan chamber 73. The washing water flows along the water stream guiding path and is spout upward via the spout outlets 75. Here, the uprising washing water stream being spouted upward is divided via the respective spout outlets 75, and twisted by rotation of the pulsator 41. Thereafter, the mutually symmetrical divided water streams rise upward and are added to each other to form a strong uprising water column. Meanwhile, some washing water scattering from the fan chamber 73 is discharged via the scattering water stream holes 77, to thereby form a scattering water stream radially upward.

The uprising water column discharged via the spout outlets 75 is spouted against the water stream descending at the center of the circulating washing water stream in the consistent direction during rotation of the pulsator 41, on the one hand, to suppress a vertical descendence of the circulating water stream, and on the other hand, to scatter radially. The scattered washing water is locally stimulated upward by the scattering water stream discharged via the scattering water stream holes 77. Thus, the torrent is formed in the washing tub 13 and simultaneously an entirely uniform pressure distribution is formed in the washing tub 13. Accordingly, twisting or entangle of the laundry in the washing tub 13 is prevented, in which case the washing capability of the laundry is improved by punching of the central uprise water stream and the scattering water stream.

As described above, according to the present invention, the pulsator for a washing machine capable of generating a vertical uprising stream in a washing tub, and having a simple suspending structure for spout fan which is generating the vertical uprising stream and simultaneously capable of assembling and disassembling easily is provided. And, the vertical uprising stream generated by the pulsator according to the present invention prevents twisting and entangle of the laundry in the washing tub.

What is claimed is:

1. A pulsator for a washing machine installed in a washing tub, comprising:

a main body rotatably installed on a bottom of the washing tub about a vertical axis said main body having a fan chamber and on upper surface formed with at least a spout outlet which is open upwardly and is in a flow communication with the fan chamber;

a spout fan having a fan shaft with an axis parallel with the vertical axis of the main body and a plurality of fan blades extending radially from the fan shaft, the spout fan being received in the fan chamber for rotation relative to the main body to eject washing water upwards through the spout outlet;

a bearing means for rotatably supporting the fan shaft in a radial direction as well as an axial direction; and means for rotating the spout fan.

2. The pulsator according to claim 1, wherein the bearing means includes a pivot supporting member mounted on the main body and a pivot recess for accommodating a lower end of the fan shaft to slidably support the lower end of the fan shaft axially and radially.

3. The pulsator according to claim 2, wherein the lower end of the fan shaft and the pivot recess each has a partially spherical contact surface corresponding to each other.

4. The pulsator according to claim 2, wherein the bearing means further includes an upper support projection projecting downwardly from a ceiling surface of the fan chamber in the axial direction of the fan shaft, and an engaging recess formed at the upper end of the fan shaft to receive the upper support projection in the axial direction of the fan shaft.

5. The pulsator according to claim 2, wherein the rotating means includes a pinion mounted integrally on the fan shaft, and a driving gear fixed on the bottom of the washing tub to cooperate with the pinion.

6. The pulsator according to claim 5, wherein the pinion has a lower contact surface toward the pivot supporting member, and the pivot supporting member has an axial bearing surface coming into an axial contact with the lower contact surface of the pinion.

7. The pulsator according to claim 6, wherein the fan shaft has a journal provided above the pinion, and the bearing means further includes a radial supporting member having a radial bearing part annularly surrounding the journal.

8. The pulsator according to claim 7, wherein the radial supporting member has a radial sector-shaped supporting part connecting the radial bearing part with a side wall of the fan chamber.

9. The pulsator according to claim 8, wherein the pinion has an upper contact surface toward the radial bearing part, and the radial bearing part has an axial bearing surface coming into an axial contact with the upper contact surface of the pinion.

* * * * *